United States Patent [19]

Mezger et al.

[11] 4,346,724

[45] Aug. 31, 1982

[54] APPARATUS FOR SPRAYING A COOLANT ON A STEEL SLAB

[75] Inventors: Sepp Mezger, Eningen; Kurt Lerch; Hans Schrewe, both of Dusseldorf; Fritz-Peter Pleschiutschnigg, Dortmund, all of Fed. Rep. of Germany

[73] Assignees: Lechler GmbH & Co. KG, Fellbach; Mannesmann AG, Dusseldorf, both of Fed. Rep. of Germany

[21] Appl. No.: 233,563

[22] Filed: Feb. 11, 1981

[51] Int. Cl.[3] ..... B08B 3/02

[52] U.S. Cl. ..... 134/122 R; 239/598; 266/113

[58] Field of Search ..... 134/64 R, 122 R; 266/113; 239/598

[56] References Cited

U.S. PATENT DOCUMENTS

| | | | |
|---|---|---|---|
| 1,918,207 | 7/1933 | Grobstein et al. | 134/122 R UX |
| 3,310,062 | 3/1967 | Little | 134/64 R |
| 3,693,352 | 9/1972 | Hinze et al. | 266/113 X |
| 3,737,108 | 6/1973 | Stumphauzer et al. | 239/598 |
| 3,856,281 | 12/1974 | Bertolotti et al. | 134/64 R X |

*Primary Examiner*—Robert L. Bleutge

*Attorney, Agent, or Firm*—Shlesinger, Arkwright, Garvey & Dinsmore

[57] ABSTRACT

The invention relates to an apparatus for spraying a coolant on steel slabs, comprising spraying nozzles preceded by a mixing chamber with separate feed lines for the propellant and the coolant, the nozzle discharges being designed in such a manner that the mixture of propellant and coolant impinges in the form of wide fans, at an acute angle and in opposite directions on the slab surface, in that the nozzle discharges start from a common nozzle housing into which issues the mixing chamber, the coolant connector to the mixing chamber consisting of an exchangeable inset tube projecting into the mixing chamber, in particular as regards slab-format castings obtained from a continuous casting mold, where the particular nozzles located in the gap between two adjoining guide rollers for the cast slab are directed parallel to the axes of the guide rollers and the nozzle housing is mounted between the plane of the guide roller axes and the slab surface.

8 Claims, 6 Drawing Figures

APPARATUS FOR SPRAYING A COOLANT ON A STEEL SLAB

BACKGROUND AND OBJECTS

Apparatus including the essential characteristics of the above state kind is the object of the earlier German patent application No. P 28 16 441.2-24. This cited earlier application substantially addresses the following problems:

(1) Achieving a uniform distribution of the mixture of water-air or steam or gas on the slab, with uniform acceleration of the mixture when being sprayed across the slab width.

(2) Spraying into the roller shadows (the triangular space between the slab surface and the roller) to be possible, with a simultaneous attempt to spray away standing water and scale particles from the roller gap by the upwardly blowing effect of the jet of the mixture.

(3) Control of the water flow rate without degrading the spraying profile and while retaining a specific nozzle.

It is the object of the present invention to improve the operation of apparatus of the initially cited kind to such an extent that (a) a wider, fan-shaped jet achieves a larger heat exchange area, (b) smaller droplets achieve more intensive cooling and the individual droplets permit faster evaporation, and (c) the non-evaporated droplets are sprayed sideways above the slab.

Further the nozzle shall be of a simpler design.

These objects are resolved by the present invention essentially in that the cylindrical or substantially cylindrical nozzle housing, which furthermore is provided with a cylindrical feed bore, comprises one prismatically shaped milling at each of two diametrically opposite locations, said milling acting as nozzle discharge and issuing radially into the feed bore.

The invention eliminates the design of the object of the earlier patent application No. P 28 16 441.2-24, namely of mutually nearly opposite nozzle discharge orifices. This elimination makes it possible in an advantageous manner to widen the depth of the jet to the desired magnitude without these jets possibly interfering (as might be the case in the object of the earlier application) with each other.

On account of the design of the invention to so build the nozzles that the jets no longer point toward each other, the nozzle at the same time also becomes simpler in structure. This feature is emphasized furthermore in a preferred embodiment of the invention in that the cylindrical feed bore of the nozzle housing is in the form of a blind hole and comprises a spherically shaped front closure, and in that the sideways millings forming the nozzle discharges issues into the radius of the spherical closure of the blind-hole feed bore of the nozzle housing.

The invention includes another essential feature in that a turbulence disk is mounted within the feed bore of the nozzle housing in front of the nozzle discharges. The turbulence disk appropriately is designed in such a manner that the previously formed mixture of water and air—which when viewed in the radial direction holds a large proportion of water at the center of the mixing chamber than at the edges—will be mixed even more intensively. In this manner the average droplet size can be advantageously decreased.

DESCRIPTION OF THE DRAWINGS

The invention presently will be illustrated in relation to the embodiments shown in the drawing and discussed further below.

DESCRIPTION OF THE INVENTION

Figure 2:
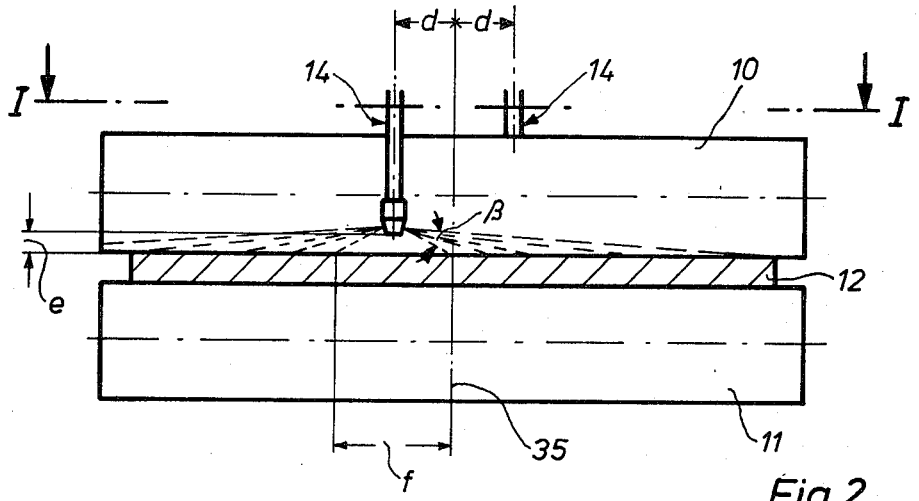
FIG. 2 is a section along line II—II in FIG. 1.

In FIG. 2, 10, 11 denote two mutually opposite guide rollers for a continuous cast steel slab. The steel slab guided between the guide rollers 10, 11 is denoted by 12. Several parallel guide rollers 10, 11 are arranged sequentially in the direction of casting 13 on both sides of the steel slab 12 and always at comparatively slight spacings a (see FIG. 1). One cooling system denoted as a whole by 14 acts between every two particular guide rollers on the upper side of the steel slab 12.

Figure 3:
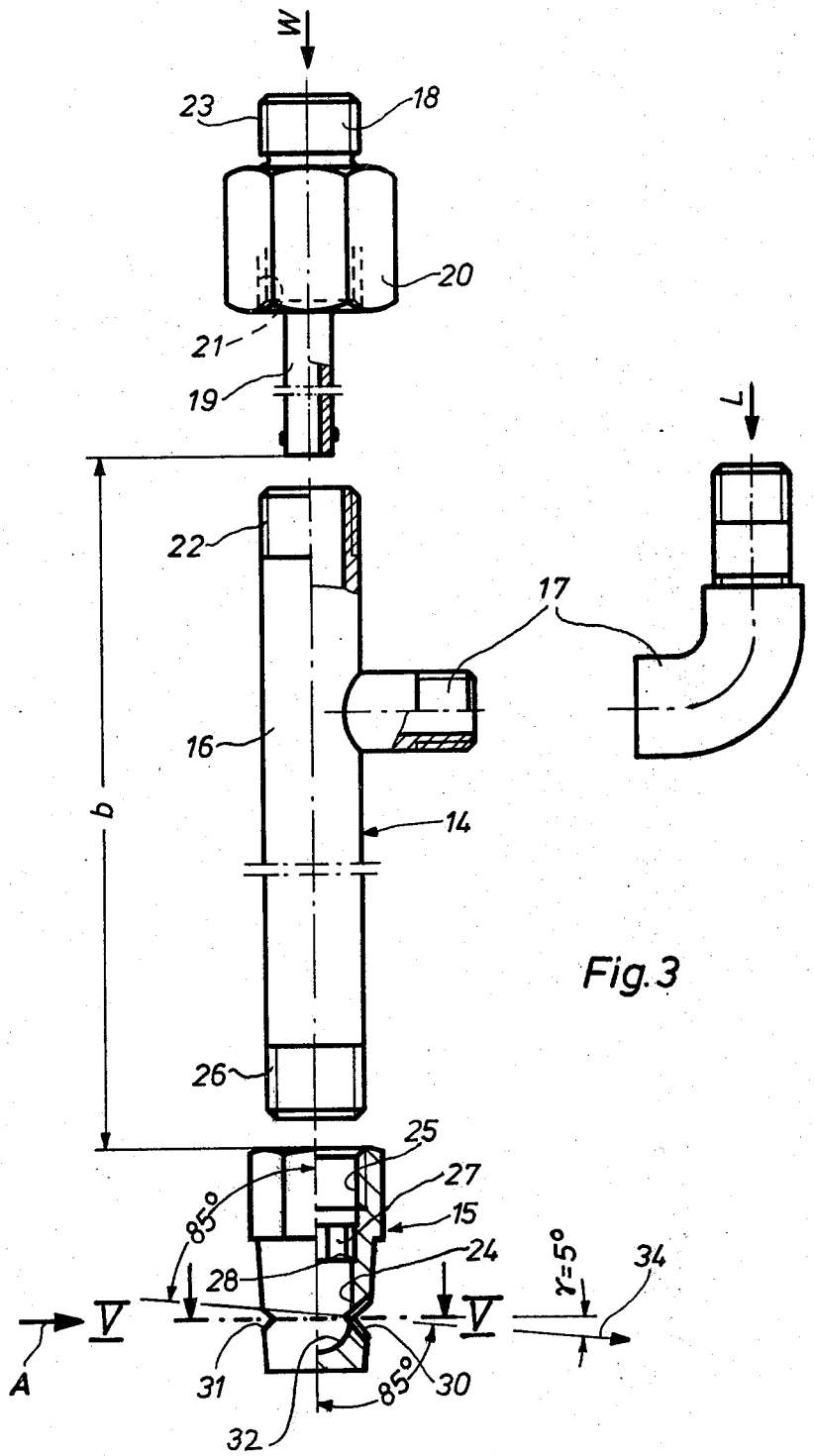
FIG. 3 is an embodiment of a coolant system (seen in elevation corresponding to FIG. 2 and partly in vertical section), enlarged with respect to FIGS. 1 and 2, where the individual parts mostly are shown disassembled.

As shown in detail in particular in FIG. 3, the cooling system 14 essentially consists of two main units, namely of a nozzle housing 15 and on the other hand of a mixing chamber 16. A connector 17 for the propellant, for instance air, issues sideways into the mixing chamber 16. The coolant, for instance water, is fed through the connector 18 to the mixing chamber 16.

As further shown in FIG. 3, the coolant connector 18 essentially is designed as an inset tube 19 which penetrates coaxially the mixing chamber 16, which is also of tubular design. A tightening nut 20 is welded to the top end of the inset tube 19 and comprises an inside thread 21. Nut 20 and thread 21 are used to tighten the inset tube 19 on a corresponding thread 22 of the mixing chamber 16. An outer thread 23 is provided at the upper end of the nut 20 for the purpose of tightening a coolant line, for instance by means of a conventional coupling nut.

The coolant, for instance water, therefore is introduced at 23 in the inset tube 19 and from there it passes into the mixing chamber 19. The flow rate of the coolant is accurately determined by the inside diameter of the particular inset tube 19 being used. By exchanging the inset tube 19 and replacing it by another of a larger or lesser diameter, it is possible therefore to vary in a simple manner the flow rate of the coolant regardless of the air flow rate introduced at 17 into the mixing chamber 16 and independently of the geometry of the nozzle housing 15. As the inset tube 19 can easily be exchanged, various flow rates of coolant to propellant can therefore be selected in a correspondingly simple manner, without changes being required in the nozzle housing 15 itself. Again, the pressure conditions relating to the coolant supply on one hand and the propellant supply on the other need not be altered in any way.

Due to the relatively large cross-sections of the mixing chamber 16, the friction losses of the mixture on its way to the nozzle discharges are kept slight, whereby an advantageous increase in the speeds of the spray jets issuing from the nozzle discharges is observed.

It is advantageous, in the sense cited above, that the flow of the mixture of liquid and propellant be divided into two partial flows only within the nozzle housing 15.

Figure 6:
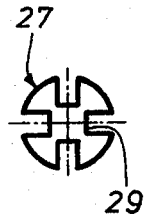
FIG. 6 is a topview of the turbulence disk of the nozzle housing, shown half in FIG. 3 sideways.

FIG. 3 further shows that the nozzle housing 15 is provided with a cylindrical feed bore 24 designed as a blind hole. The feed bore 24 is offset twice and comprises at its upper end an inside thread 25 that functions in concert with a corresponding outside thread 26 of the mixing chamber 16. A turbulence disk 27 is emplaced in the blind hole 24 and rests axially on a collar 28 of the blind hole 24 of the nozzle housing 15. The turbulence disk 27 also is shown—in topview—in FIG. 6. It comprises at its circular peripheral area four radial millings 29 which are mutually offset by 90°. On account of the turbulence disk 27, i.e. due to the described arrangement and the structure of this disk, a still more thorough mixing of the mixture of water and air present in the mixing chamber 16 is achieved, whereby a still further reduction in size of the average droplet diameter of the jets issuing from the nozzle housing 15 can be obtained.

Figure 4:
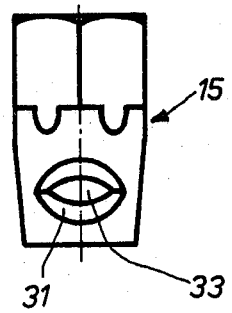
FIG. 4 is the nozzle housing of FIG. 1, seen in the direction of the arrow A.
Figure 5:
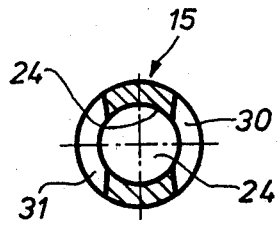
FIG. 5 is a section along line V—V in FIG. 3.

As further shown by FIGS. 3, 4 and 5, two prismatic millings 30, 31 are machined into the nozzle housing 15 at two locations diametrically opposite in said housing. The millings 30, 31 (nozzle discharges) are of such a design that they join the blind-hole feed bore 24 of the nozzle housing 15 in the spherical end zone 32 of this feed bore 24. The shape of the discharge orifices 33 so formed is shown especially clearly in FIG. 4. The prismatic millings 30, 31 incline with respect to the horizontal plane of the slab surface by an angle $\gamma=5°$ (see FIG. 3), in relation to their particular plane of symmetry (for instance 34). Because of the prismatic millings 30, 31, i.e. because of the nozzle discharges 33 thus obtaining, two wide flat jets pointing in opposite directions are generated (see FIGS. 1 and 2). Seen in top view, the two flat jets widen (FIG. 1) in each case at a larger angle $\alpha$ and perpendicularly thereto (FIG. 2) at a smaller angle $\beta$. The advantage of the jet widening at an angle $\alpha$ should be so construed that a short distance away from the discharge, the entire width of the free slab surface, as seen in the direction of casting 13, will be sprayed. The advantage of the jet widening by an angle B is that seen in the direction of the jet 34, the area of incidence of the spray jet on the slab surface is increased. Except for the sloping angle $\gamma=2°-10°$, preferably 5° (see above discussion and FIG. 3), the plane of the flat jets diverging at an angle $\alpha$ is parallel to the slab surface. This means that the free slab surface between the guide rollers 10, which is denoted by c in FIG. 1, will be sprayed at a lesser distance from the nozzle housing 15 on a larger scale than is the case for the object of the earlier application No. P 28 16 441.2-24. Due to these advantages derived from the angles $\alpha$, $\beta$, and $\gamma$, the uniformity of slab cooling is substantially improved. The above described advantages always refer to the individual flat jet. The different nature of the flat jets generated by the object of the application as compared to the earlier design per No. P 28 16 441.2-24 essentially is characterized in that individual flat jets with a wide jet angle $\alpha$ are formed with a lesser jet width perpendicular thereto (angle $\beta$), whereas in the object of the earlier application No. P 28 16 441.2-24, a somewhat flattened oval jet is obtained from an approximately round one.

A further essential differential feature with respect to the earlier embodiment per No. P 28 16 441.2-24 consists in the nozzle housing 15 being mounted at a maximum distance of 150 mm from the nozzle-side end of the inset tube 19 of the mixing chamber 16. This dimension denoted by b is shown in FIG. 3. However it applies to the assembled state of the individual parts shown disassembled in FIG. 3.

Figure 1:
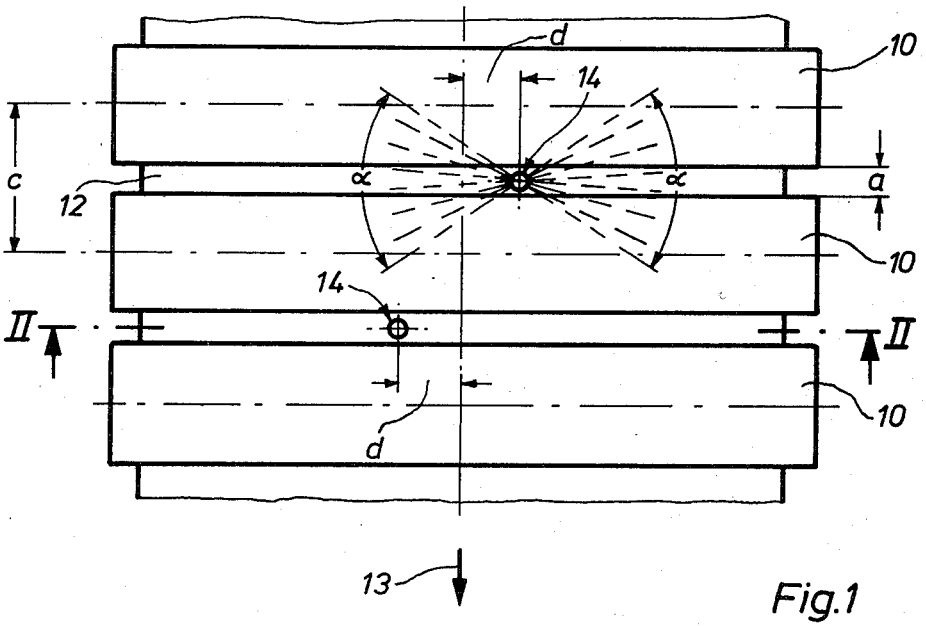
FIG. 1 is a topview (section along line I—I in FIG. 2) of part of a cast slab guided through guide rollers.

FIGS. 1 and 2 furthermore show another essential feature of the invention. It consists in offsetting in alternating manner to the left and to the right by an amount d from the center axis 35 of the cast slab the spraying system 14 which are sequentially arranged in the direction of casting. The spraying systems 14 are each mounted between the individual guide rollers 10. Depending on the magnitude e characterizing the spraying separation, the magnitude d of the lateral offset of the spraying system 14 will be selected in accordance. As clarified in FIG. 2, it amounts in each case to about half the width f of the unsprayed slab surface. Because the spraying system in the adjoining guide roller gap is offset by the same amount d to the other side of the center axis 35, it becomes possible—when considering a pair of guide rollers—to obtain again a uniform distribution of liquid on the entire width of the slab 12 to be sprayed.

In summary, the following advantages can be achieved by the apparatus of the invention: flat jets can be produced by means of the prismatic discharge orifices 30, 31 or 33, which, as seen from the center axis of the mixing chamber 16 spray outwards, and which may be designed to be variable in their spraying angles ($\alpha$ and $\beta$) depending on the geometry of the feed bore 24 and of the nozzle discharges 30, 31, 33. This makes possible a more uniform spraying of the slab surface to be cooled. Due to the mixing chamber 16 with the following turbulence disk 27 in the nozzle housing 15, better mixing of water and air, and hence smaller droplets in the spraying jets can be obtained. Due to the smaller droplets of the spray jets, more intensive cooling of the slab surface is ensured,because the individual droplets will evaporate faster. Lastly the object of the invention offers a special advantage in that the two spray jets do not intersect, rather that they spray outwardly. This allows a very simple structure for the nozzle housing.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

We claim:

1. Apparatus for spraying a coolant on steel slabs by means of spraying nozzles preceded by a mixing chamber with separate feeds for the propellant and the coolant, the nozzle discharge being designed so that the mixture of propellant and coolant is incident in the form of wide fans and at acute angle in mutually opposite directions on the slab surface, that the nozzle discharges start from a common nozzle housing into which issues the mixing chamber, and the coolant connection to the mixing chamber being an exchangeable inset tube penetrating the mixing chamber, in particular for slab-format continuous casting issuing from a continuous casting mold, the particular nozzles acting in the gap between two adjoining guide rollers for the cast slab being oriented parallel to the axes of the guide rollers and the nozzle housing being mounted between the plane of the guide roller axes and the slab surface, characterized in that the cylindrical or mearly cylindrical nozzle housing (15) which is provided with a cylindrical feed bore (24) comprises one prismatic milling (30, 31) each at two diametrically opposite locations as nozzle discharges (33), each said milling issuing radially into the feed bore (24).

2. Apparatus as in claim 1, characterized in that the nozzle discharges (30, 31, 33) are milled so as to issue into the feed bore (24) of the nozzle housing (15) each at an angle ($\gamma$) of 2°–10°, preferably 5°, with respect to the slab surface.

3. Apparatus as in claim 2, characterized in that the cylindrical feed-bore (24) of the nozzle housing (15) is designed as a blind hole and is provided with a spherically shaped front closure (32).

4. Apparatus as in claim 3, characterized in that the lateral millings (30, 31) forming the nozzle discharges (33) issue into the radius of the spherical closure (32) of the feed bore (24) of blind-hole shape of the nozzle housing (15).

5. Apparatus as in claim 1 or 4, characterized in that a turbulence disk (27) precedes the nozzle discharges (30, 31, 33) within the feed bore (24) of the nozzle housing (15).

6. Apparatus as in claim 5, characterized in that the nozzle housing (15) is mounted at a spacing (b) no more than 150 mm from the nozzle-side end of the inset tube (19) of the mixing chamber (16).

7. Apparatus as in claim 6, characterized in that the individual spray systems (14) sequentially arrayed in the direction of casting (13) each are mutually sideways offset in alternating direction by a given amount (d) with respect to the center axis (35) of the cast slab (12).

8. Apparatus as in claim 7, characterized in that the dimension (d) of the lateral offset of the spray systems (14) corresponds to about half the width (f) of the particular non-wetted slab surface.

* * * * *